US009454894B2

(12) United States Patent
Angelsmark et al.

(10) Patent No.: US 9,454,894 B2
(45) Date of Patent: Sep. 27, 2016

(54) METHOD FOR COLLECTING INFORMATION PERTAINING TO AN AUDIO NOTIFICATION SYSTEM

(71) Applicant: AXIS AB, Lund (SE)

(72) Inventors: Ola Angelsmark, Ystad (SE); Daniel Malmgren McGee, Påarp (SE)

(73) Assignee: AXIS AB, Lund (SE)

( * ) Notice: Subject to any disclaimer, the term of this patent is extended or adjusted under 35 U.S.C. 154(b) by 0 days.

(21) Appl. No.: 14/642,065

(22) Filed: Mar. 9, 2015

(65) Prior Publication Data

US 2015/0262472 A1 Sep. 17, 2015

(30) Foreign Application Priority Data

Mar. 11, 2014 (EP) ..... 14158722

(51) Int. Cl.
*G08B 29/00* (2006.01)
*G08B 29/12* (2006.01)
*H04R 29/00* (2006.01)

(52) U.S. Cl.
CPC ..... *G08B 29/126* (2013.01); *H04R 29/007* (2013.01)

(58) Field of Classification Search
None
See application file for complete search history.

(56) References Cited

U.S. PATENT DOCUMENTS 6,798,889 B1 9/2004 Dicker et al.
2004/0071294 A1* 4/2004 Halgas, Jr. ..... H04B 5/0006 381/59
2005/0018856 A1 1/2005 Kim et al.
2005/0254662 A1 11/2005 Blank et al.
2009/0081948 A1* 3/2009 Banks ..... H04R 5/02 455/3.05
2012/0286946 A1* 11/2012 Karl ..... G08B 29/126 340/516

FOREIGN PATENT DOCUMENTS

EP 0989776 A2 3/2000
EP 1435756 A2 7/2004
NL WO 2007135581 A2 * 11/2007 ..... H04R 5/02
WO 2007110478 A1 10/2007
WO 2007135581 A2 11/2007
WO 2008046141 A1 4/2008
WO 2012137190 A1 10/2012

* cited by examiner

*Primary Examiner* — Travis Hunnings
(74) *Attorney, Agent, or Firm* — Volpe and Koenig, P.C.

(57) ABSTRACT

The present invention is directed towards a method for collecting information pertaining to an audio notification system comprising a plurality of audio devices and a database, wherein each of the plurality of audio devices comprises a loudspeaker and a microphone, the method comprising: sequentially for each of the plurality of audio devices: emitting, by means of the loudspeaker of a currently emitting audio device, an audible test sound; monitoring, by means of microphones of the audio devices in the system, for the audible test sound; and for each monitoring audio device, if the audible test sound is detected by the monitoring audio device, storing, in the database, information pertaining to the currently emitting audio device and information pertaining to the monitoring audio device detecting the audible test sound.

12 Claims, 4 Drawing Sheets

METHOD FOR COLLECTING INFORMATION PERTAINING TO AN AUDIO NOTIFICATION SYSTEM

CROSS REFERENCE TO RELATED APPLICATION

This application claims the benefit of European Patent Application No 14158722.0 filed on Mar. 11, 2014, which is incorporated by reference as if fully set forth.

FIELD OF INVENTION

The present invention relates to a method for collecting information pertaining to an audio notification system.

BACKGROUND

Audio notification systems used for notifying information to occupants of a building or people within an outdoor environment such as a train station, a stadium, a slope in a skiing resort, etc. are commonly used today for notifying information such as evacuation alarms (e.g. fire alarms), alert messages, messages informing people about the departure and arrival of planes, busses and/or trains, advertising messages in department stores, etc. Similar audio notification systems may also be located on a vehicle for public transportation such as a plane, a buss, a train, a boat or somewhere else information is sent to people by audio. The audio notification system comprises a plurality of audio devices being arranged to emit audible sound.

Depending on the use of an audio notification system different problems exist.

For an audio notification system used for evacuation alarms it is crucial that all areas of a building, an outdoor environment or a vehicle for public transportation are covered such that in case of an emergency the evacuation alarm is notified to all occupants of the building, all people of the outdoor environment or all people of the vehicle for public transportation. However, it is difficult to test the audio notification system to check if all areas are covered. A common method to do this is to simultaneously put all the audio devices of the audio notification system in an alarm mode such that all the audio devices are emitting an audible evacuation alarm and then having a test person walking around in the building, outdoor environment or vehicle for public transportation to check if all areas are covered by the audible evacuation alarm. Moreover, such testing needs to be repeated at regular times in order to safeguard that the audio notification system is working properly.

In addition to the above problem of not covering all areas of a building, an outdoor environment or a vehicle for public transportation, a problem with audio notification systems used for alert messages, messages informing people about the departure and arrival of planes, busses and/or trains, advertising messages in department stores, etc is to safeguard so that the audible sound emitted by the audio devices of the audio notification system is of such quality that the information in the messages can be heard by the intended recipients. This is often troublesome to achieve; this since it is hard to properly adopt the audio level of the sound emitted from the different audio devices of the audio notification system such that no distortion is present or such that the audio level is not to weak resulting in that the messages are not perceived by the intended recipients.

Another problem, especially often present in audio notification systems spread over a big area, is that people will be hearing echoes from loudspeakers further away. Such a typical big area is a slope in a skiing resort.

A common problem with all audio notification systems of today is that if one or more audio device within the audio notification system are not working properly, the original set up of the audio notification system is outdated such that not all areas of the building, the outdoor environment or the vehicle for public transportation are covered or such that the quality of the audible sound is not good enough

SUMMARY

In view of the above, an objective of the invention is to provide a method for collecting information pertaining to an audio notification system such that the above mentioned problems may be eliminated or at least be minimized.

According to a first aspect, the present invention is realized by a method for collecting information pertaining to an audio notification system comprising a plurality of audio devices and a database, wherein each of the plurality of audio devices comprises a loudspeaker and a microphone, the method comprising: sequentially for each of the plurality of audio devices: emitting, by means of the loudspeaker of a currently emitting audio device, an audible test sound; monitoring, by means of microphones of the audio devices in the system, for the audible test sound; and for each monitoring audio device, if the audible test sound is detected by the monitoring audio device, storing, in the database, information pertaining to the currently emitting audio device and information pertaining to the monitoring audio device detecting the audible test sound.

By "audio notification system" is meant a system comprising audio devices used for notifying information to people. The audio notification system may be located inside a building, in an outdoor environment such as a train station, a bus station, a stadium, a slope in a skiing resort, etc. or in a vehicle for public transportation such as a train, a bus, an airplane, a boat, etc. Examples of information to be notified by the audio notification system are evacuation alarms (e.g. fire alarms), alert messages, messages informing people about the departure and arrival of planes, busses and/or trains, advertising messages in department stores, etc.

By "database" is meant an organized collection of digital data/information. The database itself may be contained in a single computer memory or it may be distributed among a plurality of computer memories. In case of the database being located in a single computer memory this memory may be located in one of the audio devices; alternatively the computer memory may be located in a server. In case of the database being located in a plurality of computer memories these memories may be located in a plurality of audio devices; alternatively these memories may be located in a plurality of audio devices and also in other devices such as a server. In case of different devices of the audio notification system having memories for storing data pertaining to the database, the database might be fully mirrored in all or some of the devices.

By means of the information stored in the database the audio notification system only need to be set into the information collection mode once. Using the collected information stored in the database it may be safeguarded that the audio notification system is working properly at all times. For example defective audio devices in the system may be accounted for by adjusting the audio level of the remaining audio devices of the system. The amount of adjustment needed may be deduced from the collected information stored in the database. Hence, if the audio notification system is an emergency notification system it may be safeguarded so that the emergency notification system is working properly, i.e. all areas of the building, the outdoor environment or the vehicle for public transportation are covered, at all times without the need of regular testing of the system. Moreover, the collected information pertaining to the audio notification system stored in the database may be used to set the audio notification system so that an audible sound with good quality may be present throughout the building, the outdoor environment or the vehicle for public transportation comprising the audio notification system. Furthermore, in case of an audio device of the audio notification system is becoming defective the collected information pertaining to the audio notification system stored in the database may be used to adjust emitted audio levels of the remaining audio devices of the audio notification system in order to compensate for the defective audio device.

By "defective" is meant that the audio device is no longer working properly. This might e.g. be the case if the audio device no longer can communicate with the other audio devices of the system or if the loudspeaker is not working.

The information pertaining to the currently emitting audio device may comprise a unique identification of the currently emitting audio device. The information pertaining to the monitoring audio device may comprise a unique identification of the monitoring audio device detecting the audible test sound.

The information pertaining to the monitoring audio device may comprise an audio level of the detected audible test sound.

The step of emitting an audible test sound may comprise sequentially emitting a plurality of audible test sounds, wherein information pertaining to the currently emitting audio device may comprise an audio level of the emitted audible test sound. By sequentially emitting a plurality of audible test sounds, audible test sounds with varying audio level may be emitted. By doing so, audio level thresholds may be found indicating when audio devices of the audio notification system may not detect emitted sound from other audio devices.

The plurality of audible test sounds may be emitted with increasing audio level. The method then further comprises: for each monitoring audio device, if the audible test sound is detected by the monitoring audio device, notifying that the emitted audible test sound is detected; and stopping emission of audible test sound from the emitting audio device if the number of notifications exceeds a threshold.

The plurality of audible test sounds may be emitted with decreasing audio level. The method then further comprising: for each monitoring audio device, if the audible test sound is detected by the monitoring audio device, notifying that the emitted audible test sound is detected. By using decreasing audio levels information pertaining to which audio device that is closest to the currently emitting audio device may be deduced.

The method may further comprise, in connection with the step of notifying, storing in the database information pertaining to an identification of the currently emitting audio device, an audio level of the emitted audible test sound, an identification of the monitoring audio device detecting the audible test sound and an audio level of the detected audible test sound.

The method may further comprise stopping emission of audible test sound from the currently emitting audio device if no monitoring audio device is longer detecting the audible test sound.

The information pertaining to the currently emitting audio device may comprise a geographical position of the currently emitting audio device. The information pertaining to the monitoring audio device may comprise a geographical position of the monitoring audio device. The geographical position of the audio device may be determined by means of a GPS-unit (or the like) comprised in the audio device. By determining the geographical position of the audio devices it may be determined which audio devices being closest to each other geographically.

The method may further comprise grouping, based on information stored in the database, the audio devices of the audio notification system into subgroups of audio devices, wherein each subgroup of audio devices comprises two or more audio devices.

The method may further comprise setting, for each of the audio devices in the system, the audio level of the audio device based on information stored in the database.

The method may further comprise: detecting that an audio device of the system is defective; and adjusting the audio levels of the remaining audio device based on information already stored in the database.

The step of adjusting may comprise comparing, for each of the remaining audio devices, the stored information pertaining to the audio level of the emitted audible test sound from the defective audio device for determining the audio device among the remaining audio devices having detected emitted audible test sound from the defective audio device having the lowest audio level and increasing the audio level emitted by the determined audio device such that the defective audio device is compensated for.

Alternatively or in combination the step of adjusting may comprise determining the subgroup of audio devices comprising the defective audio device and increasing the audio level emitted by the rest of the audio device in the determined subgroup of audio devices such that the defective audio device is compensated for.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

This and other aspects of the present invention will now be described in more detail, with reference to the appended drawings showing embodiments of the invention. As illustrated in the figures, the sizes are exaggerated for illustrative purposes and, thus, are provided to illustrate the general structures of embodiments of the present invention. Like reference numerals refer to like elements throughout.

DETAILED DESCRIPTION OF THE PREFERRED EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
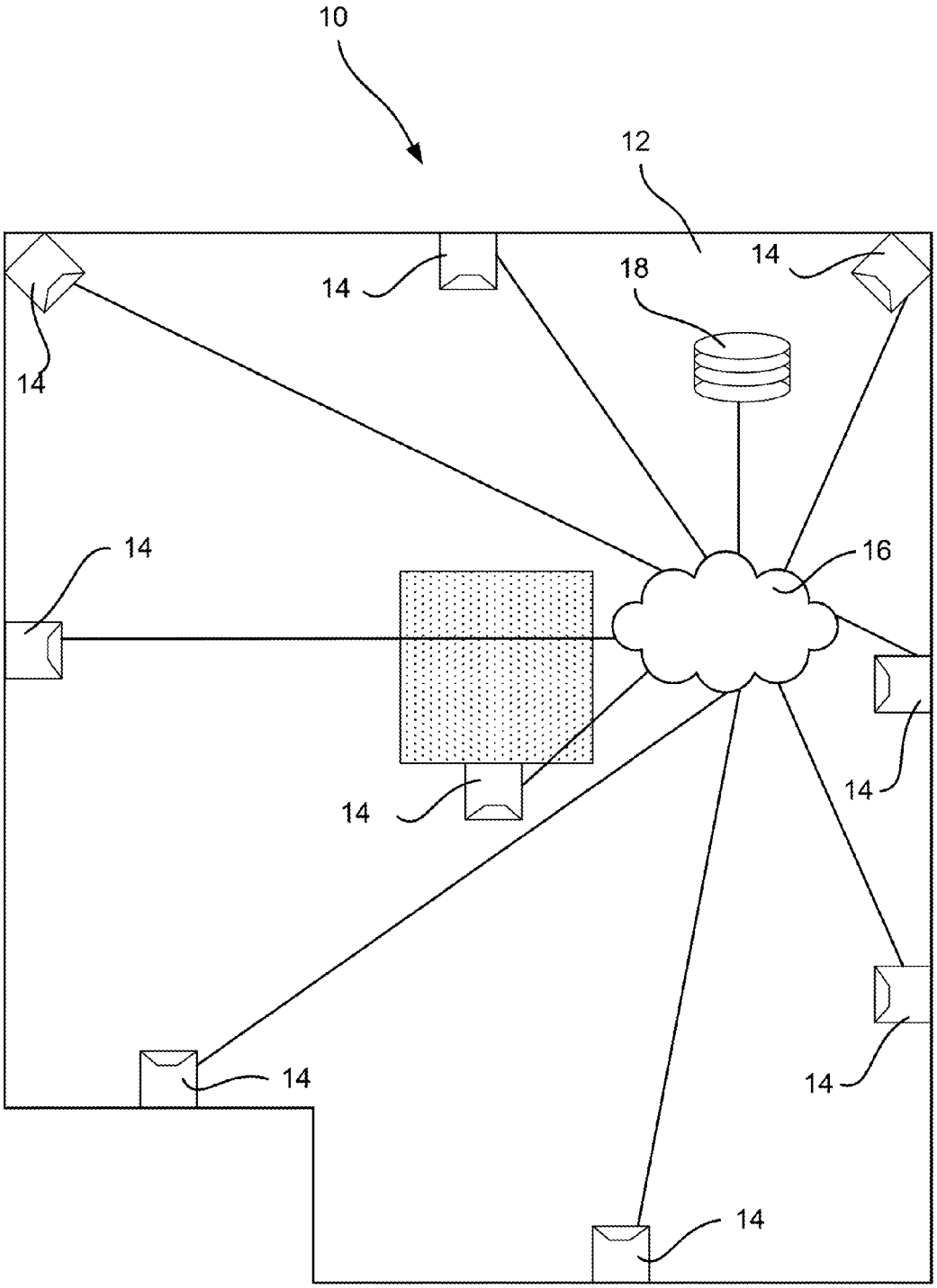
FIG. 1 schematically illustrates an audio notification system being arranged in a building.

FIG. 1 schematically illustrates an audio notification system 10 being arranged in a building 12. It is realized that the audio notification system 10 may be arranged in other types of locations as well. Two other examples of locations are an outdoor environment such as a train station, a bus station, a stadium, a slope in a skiing resort, etc. and a vehicle for public transportation such as a train, a boat, an airplane a bus, etc. However, it is realized that the audio notification system 10 may be arranged in any location where an audio notification system is needed in order for informing people by audio. The audio notification system 10 comprises a plurality of audio devices 14 and a database 18.

The plurality of audio devices is connected to each other via a digital communication network 16, such as the Internet or a Local Area Network (LAN). The plurality of audio devices 14 may thus communicate digital information with each other. The communication within the digital communication network 16 may be made with a suitable communication protocol. Examples of a suitable communication protocols are TCP/IP, UDP/IP.

The database 18 is connected to the plurality of audio devices 14 via the digital communication network 16. The database 18 is arranged to store information, in the form of digital data, pertaining to the audio devices 14 of the audio notification system 10. The database 18 comprises one or more digital data storage memories for storing digital data. The digital data storage memory/memories of the database 18 may, as shown in the embodiment of FIG. 1, be arranged in a single device or unit, such a device may e.g. be a computer server. Alternatively, the digital data storage memories of the database may be arranged in a plurality of devices or units. These devices or units may e.g. be different computer servers or audio devices 14 of the audio notification system 10. Hence, an audio device 14 of the audio notification system 10 may comprise a digital data storage memory forming part of the database 18.

Figure 2:
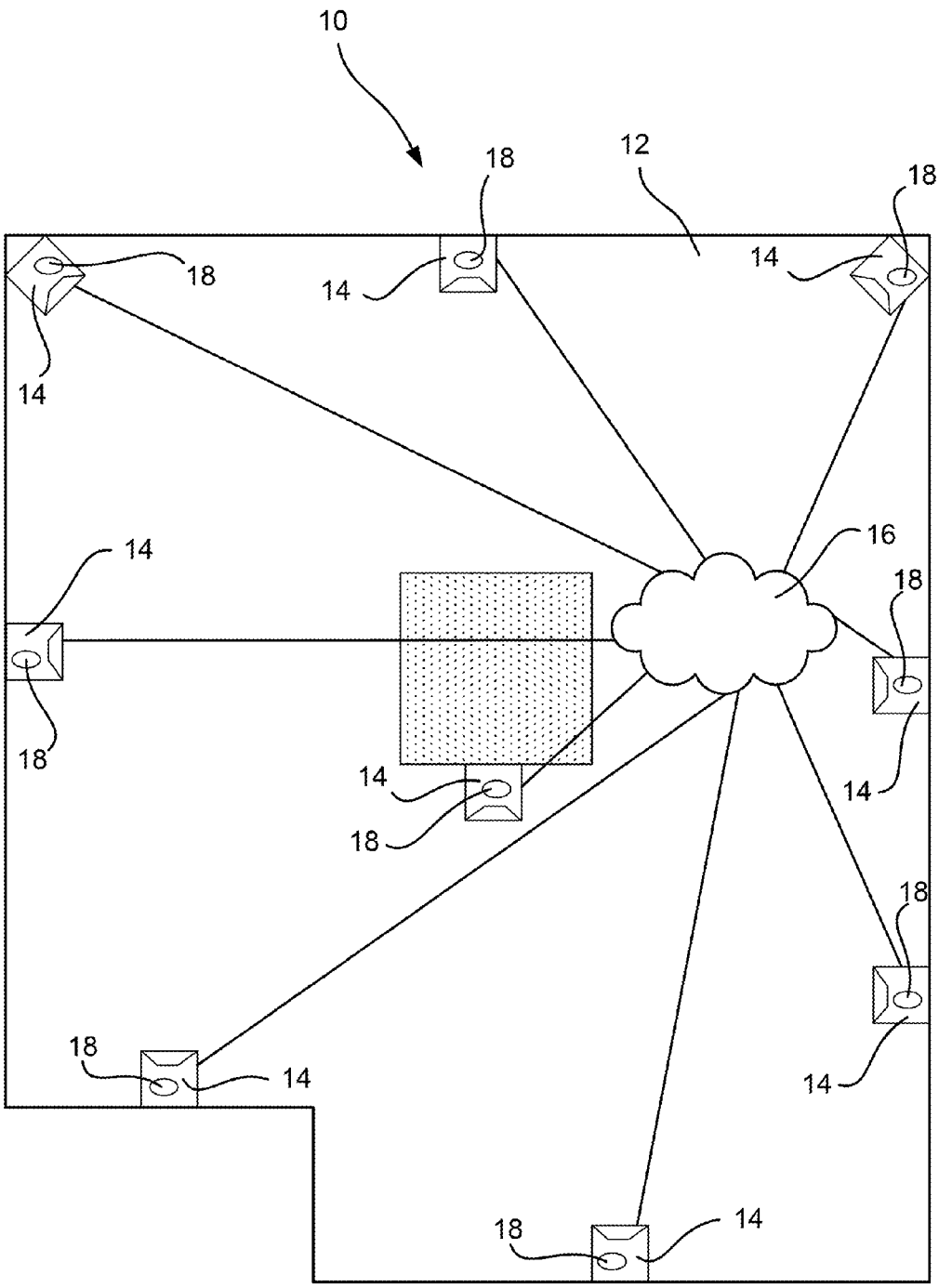
FIG. 2 schematically illustrates an alternative audio notification system being arranged in a building.

In FIG. 2 an embodiment of an audio notification system 10 wherein the audio devices 14 of the audio notification system 10 comprises digital data storage memories of the database 18 is illustrated. It shall be noted that not all the audio devices 14 of the audio notification system 10 need to comprise a digital data storage memory of the database 18. Moreover, it shall also be noted that also other devices being connected to the digital communication network 16 may comprise a digital data storage memory of the database 18.

Figure 3:
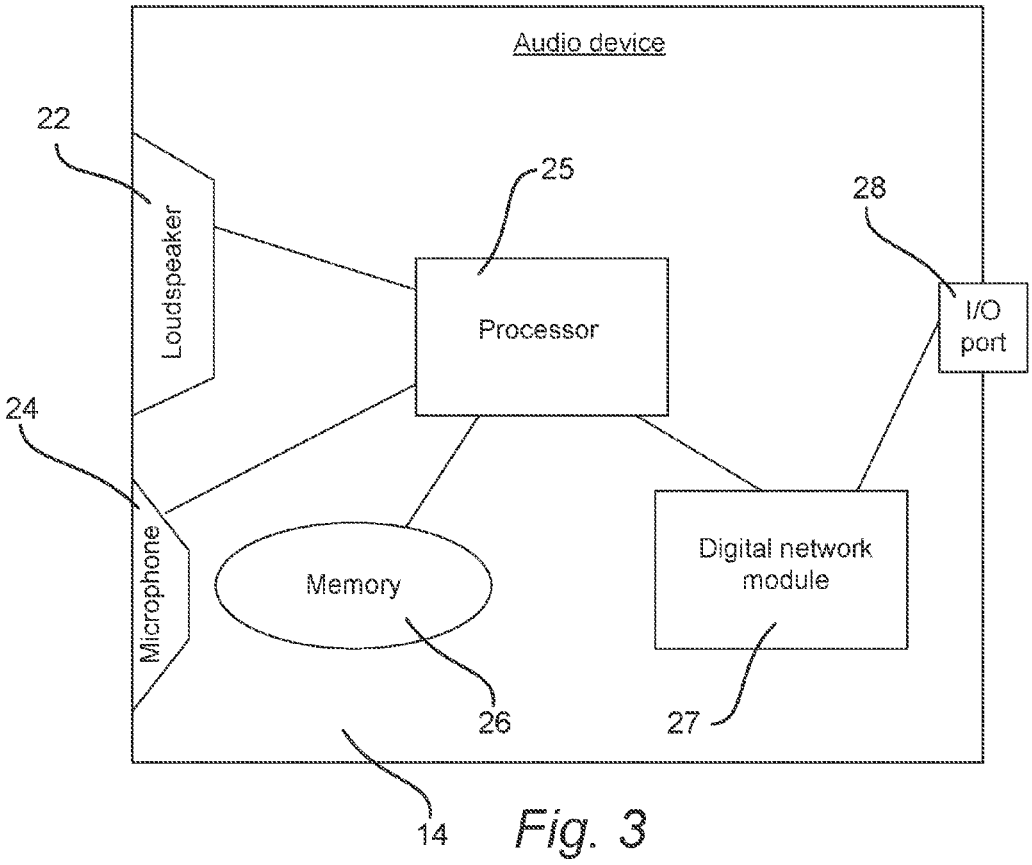
FIG. 3 schematically illustrates an audio device.

In FIG. 3 an embodiment of an audio device 14 of the audio notification system 10 is illustrated. The audio device 14 comprises a loudspeaker 22, a microphone 24, a processor 25, a digital data storage memory 26, a digital network module 27 and an input/output port (I/O port) 28.

The audio device 14 is arranged to be connected to the digital communication network 16. The connection to the digital communication network 16 may be wired or wireless. The digital network module 27 is arranged to transmit and receive digital signals via the I/O port 28. The I/O port 28 may be a network port adapted to 10/100/1000 Mbps data traffic. One example of such a network port is an Ethernet port. An Ethernet port being a modular port arranged to receive a modular connector, e.g. a RJ45 connector. Normally, such a RJ45 connector port is arranged to receive a network cable, such as a twisted pair cable (e.g. of cat 5, cat 5*e* or cat 6). Alternatively the I/O port 28 may be a wireless I/O port using wireless digital communication internet standards, such as Wi-Fi, Bluetooth or a mobile phone communication technology standard (3G, 4G, etc.).

The loudspeaker 22 is arranged to emit audible sound. The audible sound may comprise a sound having a single frequency. Alternatively the audible sound may comprise a sound having multiple frequencies. The frequency or frequencies of the audible sound emitted by means of the loudspeaker 22 is controlled by means of the processor 25. Moreover, the audio level (volume) of the audible sound emitted by means of the loudspeaker 22 is controlled by means of the processor 25. The signal controlling the loudspeaker 22 is typically an analog signal. Hence, it is realized that the audio device 14 also comprises a digital to analog converter (not shown). This since the processor is working with digital signals.

The microphone 24 is arranged to monitor/detect audible sound. The processor 25 is arranged to receive signals from the microphone 24 pertaining to the frequency or frequencies of the monitored/detected audible sound. Moreover, the processor 25 is arranged to receive signals from the microphone 24 pertaining to the audio level of the monitored/detected audible sound. The signals, pertaining to the frequency or frequencies of the monitored/detected audible sound and pertaining to the audio level of the monitored/detected audible sound, generated by the microphone 24 are typically analog signals. Hence, it is realized that the audio device 14 also comprises an analog to digital converter (not shown). This since the processor is working with digital signals.

According to one embodiment of the present invention the audio device 14 is comprised in a digital network camera.

Figure 4:
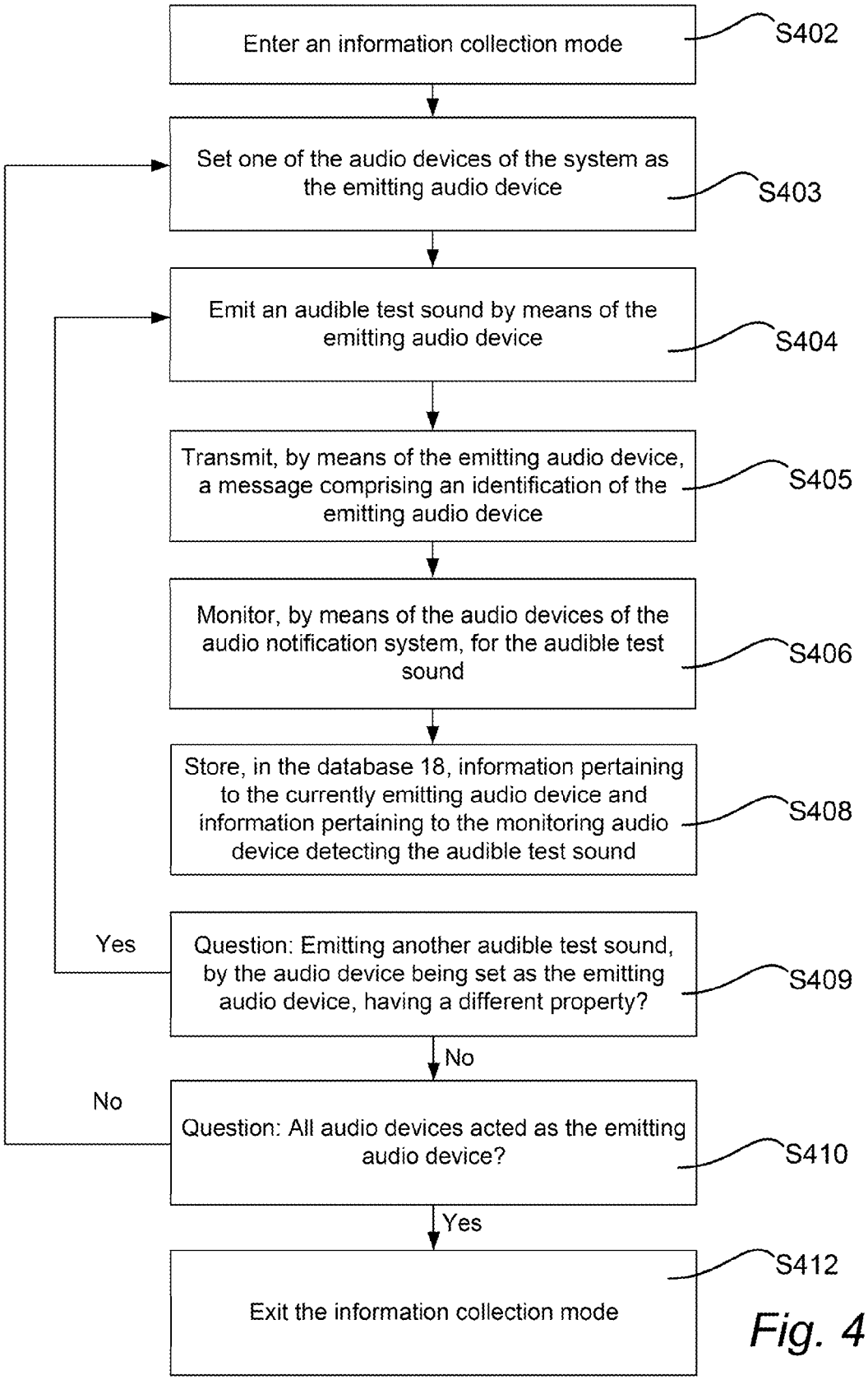
FIG. 4 is a block diagram for a method, according to the present invention, for collecting information pertaining to an audio notification system.

Next, with reference to FIG. 4 a method for collecting information pertaining to an audio notification system 10 according to the above will be discussed.

The method starts with that an agent (a human, a server, an application or otherwise) request collection of information pertaining to the audio notification system 10. This will cause the audio devices 14 of the audio notification system 10 to enter, step S402, an information collection mode.

When being in the information collection mode each audio device among 14 the audio devices of the audio notification system 10 is, sequentially, according to an arbitrary ordering, set to emit, step S404, an audible test sound. Hence, the audio devices 14 are set to emit, step S404, an audible test sound one at a time. At any given moment, during the information collection mode, only one audio device among the audio devices 14 is acting as an emitting audio device. The audio device currently to act as the emitting audio device is set in step S403. The audio level of the audible test sound is set to a predetermined value. The audible test sound may e.g. be a chirp. The emitting audio device is arranged to emit the audible test sound for a predetermined time. The emitting audio device is arranged to emit the audible test sound by means of its loudspeaker. The emitting audio device is also arranged to, via the digital communication network 16, transmit, step S405, a message comprising an identification of the emitting audio device. The message comprising the identification of the emitting audio device is typically transmitted using broadcasting. The identification of the emitting audio device is preferably a unique identification. The unique identification may e.g. be information pertaining to the MAC-address of the emitting audio device or information pertaining to a unique serial number belonging to the emitting audio device. The emitting audio device may also be arranged to transmit a message comprising an audio level of the emitted audible test sound. The message comprising the identification of the emitting audio device and the message comprising an audio level of the emitted audible test sound may be combined into one message.

The audio devices 14 of the audio notification system 10 is set to monitor, step S406, for the audible test sound emitted by the emitting audio device. Especially, but not necessarily, all audio devices 14*a* but the currently emitting audio device emitting the audible test sound is set to monitor for the audible test sound. The audio device(s) 14 being set to monitor for the audible test sound will hereafter be referred to as monitoring audio device(s). Each monitoring audio device is set to monitor for the audible test sound by means of its microphone. Each monitoring audio device that detects the audible test sound from the emitting audio device is arranged to, in the database 18, store, step S408, information pertaining to the currently emitting audio device and information pertaining to the monitoring audio device detecting the audible test sound. Depending on the structure of the database 18 this information may be stored locally and/or remotely. The information pertaining to the currently emitting audio device may comprise the unique identification of the currently emitting audio device. The information pertaining to the monitoring audio device detecting the audible test sound may comprise a unique identification of the monitoring audio device detecting the audible test sound. The unique identification may e.g. be information pertaining to the MAC-address of the monitoring audio device detecting the audible test sound or information pertaining to a unique serial number belonging to the monitoring audio device detecting the audible test sound. Moreover, the information pertaining to the emitting audio device may comprise the audio level of the emitted audible test sound. Furthermore, the information pertaining to the monitoring audio device detecting the audible test sound may comprise an audio level of the detected audible test sound. An audio level threshold may also be set so that detecting the audible test sound is only accounted for when the audible test sound is detected above the audio level threshold.

Optionally, each monitoring audio device that detects the audible test sound from the emitting audio device is arranged to notify, via the digital communication network 16, to the emitting audio device that the emitted audible test sound was detected.

Also optionally, the emitting audio device is set to wait for responses from monitoring audio devices. The emitting audio device is set to wait for a predetermined time, or until at least a predetermined number of monitoring audio devices have responded.

After emitting the audible test sound for the predetermined time the emitting audio device may be arranged to emit another audible test sound having a different audio level and/or different frequency than the recently emitted audible test sound. This is checked for in step S409. Hence, the method may comprise, for each audio device acting as the emitting audio device, sequentially emitting a plurality of audible test sounds. Hence, typically each of the plurality of audible test sounds emitted by the audio device currently acting as the emitting audio device will hence have at least one property being different than the other plurality of audible test sounds.

According to one embodiment the plurality of audible test sounds is emitted with increasing audio level. If this is the case, each monitoring audio device that detects the audible test sound from the emitting audio device is arranged to notify, via the digital communication network 16, to the emitting audio device that the emitted audible test sound was detected. In connection with the detection of the audible test sound, each monitoring audio device is arranged to, in the database 18, store at least one of the following categories of information: information pertaining to an identification of the currently emitting audio device, information pertaining to an audio level of the emitted audible test sound, information pertaining to an identification of the monitoring audio device detecting the audible test sound and information pertaining to an audio level of the detected audible test sound. By doing so, a mapping of how the audio levels of the audible sounds emitted by the emitting audio device will be perceived at the monitoring audio device may be made. Furthermore, the emitting audio device may be set to wait for a predetermined time, or until at least a predetermined number of monitoring audio devices have responded. The emitting audio device may further be arranged to stop the emission of audible test sound from the emitting audio device if the number of notifications exceeds a threshold. However, if less than a predetermined number of monitoring audio devices has notified the emitting audio device, the emitting audio device is arranged to increase the audio level with a predetermined value unless the increment would make the audio level above a preset threshold.

According to another embodiment the plurality of audible test sounds may be emitted with decreasing audio level. According to this embodiment, each monitoring audio device is arranged to: if the audible test sound is detected by the monitoring audio device, notify to the emitting audio device, that the emitted audible test sound is detected. The monitoring audio device is arranged to notify the emitting audio device via the digital communication network. In connection with the detection of the audible test sound, each monitoring audio device is arranged to, in the database 18, store at least one of the following categories of information: information pertaining to an identification of the currently emitting audio device, information pertaining to an audio level of the emitted audible test sound, information pertaining to an identification of the monitoring audio device detecting the audible test sound and information pertaining to an audio level of the detected audible test sound. By doing so, a mapping of how the audio levels of the audible sounds emitted by the emitting audio device will be perceived at the monitoring audio device may be made. By using decreasing audio levels information pertaining to which audio device that is closest to the currently emitting audio device may be deduced. Furthermore, the emitting audio device is set to wait for a predetermined time, or until at least a predetermined number of monitoring audio devices have notified that the emitted audible test sound is detected. As long as at least one of the monitoring audio devices is notifying the emitting audio device that the emitted audible test sound is detected, the emitting audio device is arranged to emit a new audible sound with a decreased audio level. The audio level is decreased with a predetermined value. If no monitoring audio device has notified the emitting audio device within the predetermined time the emitting audio device is arranged to exit the mode of emitting audible test sounds with decreasing audio level.

The embodiment of increasing audio levels and the embodiment of decreasing audio levels may be used in connection with each other. For example the emitting audio device may start with emitting an audible test sound with a first audio level, and then the audio level of the audible test sound may be increased with a first predetermined amount a number of times until the predetermined threshold for maximum audio level has been reached. Thereafter the audio level may be decreased with a second predetermined amount a number of times until no monitoring audio devices detects the emitted audible test sound. The first and second predetermined amount may be set to be different amounts. Alternatively, the first and second predetermined amount may be set to be the same amount.

When all audible test sounds have been emitted by the audio device currently acting as the emitting audio device, it is checked, step S410, if all audio devices have acted as the emitting audio device. If this is the case, the information collection mode is exited, step S412. If not, another one of the audio devices in the audio notification system is set to act as the emitting audio device. Hence, the method returns to step S403.

After each audio device 14 of the audio notification system 10 has acted as the emitting audio device, the database 18 will comprise information pertaining to which audio devices that are able to detect audible sound emitted by which other audio device. In case of storing, in the database 18, information pertaining the emitted and detected audio levels, each audio device knows the detected versus emitted audio level of each other audio device (that are close enough to be detected.) in the system. Moreover, a constraint may also be set so that the database 18 comprise information pertaining to which audio devices that are able to, above a predetermined audio level threshold, detect audible sound emitted by which other audio device. Further, for each audio device 14, the database 18 may possibly also comprise information pertaining to the detectable audio level of the emitted audible sound as a function of the audio level of the emitted audible sound. Hence, the database 18 may comprise which audio device that are being able to detect audible sound emitted by an emitting audio device at a given audio level of the emitted audible sound emitted by the emitting audio device.

Next it will be discussed how the collected information collected during the information collection mode may be used for setting the audio notification system during a setting mode. The information comprised in the database 18 may be used to set the audio notification system 10. During the setting, the audio level of the audio devices is set based on information stored in the database.

During the setting, the audio level of the emitted audible sound from each audio device may be set so that at least one other audio device, except the audio device emitting the audible sound, is detecting the audible sound.

The information in the database 18 may be used to group the audio devices into subgroups. In each subgroup all audio devices belonging to that subgroup is able to detect audible sound emitted from a specific audio device. The members of the subgroup may also be set to detect audible sound above a predetermined threshold in order to be accounted as being members of the subgroup. Hence, the database 18 will comprise a number of subgroups, each of which can detect audible sound emitted from a specific audio device. This would be an automatically assigned subgroup. It shall be noted that a given audio device may belong to a number of subgroups. The assigned subgrouping may then be used to e.g. ensure redundancy in the event of audio device of the audio notification system later being defective. The audio notification system 10 may also be arranged to issue a warning if one or more audio device may not be grouped into a subgroup.

By using software running on, e.g. a computer providing audio streams for the system; or via a configuration page in a web GUI for the system or for an audio device, the audio device may also be partitioned into subgroups according to some criteria. For example, if the speakers are positioned on a map of the building, the outdoor environment of the vehicle for public transportation, one could simply point-and-drag an area around the audio devices ascribing the audio devices as belonging to a certain subgroup. This would be a manually assigned subgroup.

A specific subgroup, automatically or manually assigned, may be set to play a specific audio stream. Various subgroups of the audio notification system may be set to play different audio streams.

In case of it is detected that an audio device of the system is defective, the audio levels of one or more of the remaining audio device may be adjusted based on information already stored in the database 18.

Detecting that an audio device is defective or malfunctioning may be made in various ways.

In case of an audio device, it may be physically removed; the power driving the audio device may be lost; or for some other reason the audio device may not send or receive data. This can be detected via e.g. heartbeat monitoring, Simple Network Management Protocol (SNMP), or some other form of external monitoring. Some, or all of the other devices in the system, can be set to monitor other devices, raising an alarm if an audio device disappears from the network. Alternatively, a single device, for example the server broadcasting the audio to be emitted by the audio notification system, can perform the monitoring.

In case of the loudspeaker of an audio device malfunctions or has degraded output, but the device functions normally. This can be detected via the microphone of the audio device or the microphone of some other audio device in the system. This may be made either by noting that the audio is gone or, by using an audio quality analysis, if the audio emitted by the loudspeaker is not up to par. The audio device can then raise the alarm itself. Alternatively, the audio device comprising the microphone detecting that the audio is missing or not up to par can raise the alarm.

Electrical malfunction of a loudspeaker can be detected via e.g. an end-of-line resistor (EOLR).

In case of an audio device appears to function normally, and emits audio, but the controlling of the loudspeaker of the audio device malfunctions and does not, e.g., change audio even though it responds correctly to all requests. This may be detected by means of the microphone of the audio device. By comparing the audio detected by the microphone to the requested audio, it may be detected if there are major differences between expected and detected audio.

The step of adjusting may comprise comparing, for each of the remaining audio devices, the stored information pertaining to the audio level of the emitted audible test sound from the defective audio device for determining the audio device among the remaining audio devices having detected emitted audible test sound from the defective audio device having the lowest audio level and increasing the audio level emitted by the determined audio device such that the defective audio device is compensated for.

Alternatively or in combination the step of adjusting may comprise determining the subgroup of audio devices comprising the defective audio device and increasing the audio level emitted by the rest of the audio device in the determined subgroup of audio devices such that the defective audio device is compensated for.

Moreover, if the remaining audio devices realize that they will not be able to compensate for the defective audio device, an alarm may be issued. Such an alarm may e.g. be sent as a message over the network, e.g. as an e-mail, an SMS or some other kind of suitable message. Alternatively or in combination the alarm may be issued as an audible message using the loudspeakers.

The person skilled in the art realizes that the present invention by no means is limited to the preferred embodiments described above. On the contrary, many modifications and variations are possible within the scope of the appended claims.

For example, the information pertaining to the currently emitting audio device may comprise a geographical position of the currently emitting audio device and/or the information pertaining to the monitoring audio device may comprise a geographical position of the monitoring audio device. By knowing the geographical position of the audio devices 14 it may be determined which audio devices 14 are closest to each other.

The geographical position of an audio device 14 may be determined by means of a physical location determining unit (a GPS-unit or the like, not shown) comprised in the audio device 14. Alternatively or in combination, the geographical position of an audio device 14 may be set when installing the audio device 14 at the building 12. Alternatively or in combination, the geographical position of the audio devices 14 within the audio notification system 10 may determine if the audio notification system 10 is sharing a common time using, e.g. NTP or PTP. If so, by broadcasting a measure of the time when an audible sound is emitted from the emitting audio device and recording the time when the audible sound was detected by the monitoring audio device the distance between the emitting audio device and the monitoring audio device is easily determined. By knowing distances between different audio devices of the audio notification system 10 relative geographical positions between the audio devices of the audio notification system 10 may be determined.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

What is claimed is:

1. A method for collecting information pertaining to an audio notification system including a plurality of audio devices and a database, wherein each of the plurality of audio devices comprises a loudspeaker and a microphone, the method comprising:

sequentially for each of the plurality of audio devices:

sequentially emitting, by the loudspeaker of a currently emitting audio device, a plurality of audible test sounds with increasing or decreasing audio level;

monitoring, by microphones of the audio devices in the system, for the audible test sounds; and for each monitoring audio device, if an audible test sound is detected by the monitoring audio device, storing, in the database, information pertaining to an identification of the currently emitting audio device, an audio level of the emitted audible test sound, an identification of the monitoring audio device detecting the audible test sound and an audio level of the detected audible test sound.

2. The method according to claim 1, wherein the identification of the currently emitting audio device is unique and wherein the identification of the monitoring audio device is unique.

3. The method according to claim 1, wherein the plurality of audible test sounds is emitted with increasing audio level, the method further comprising:

for each monitoring audio device, if the audible test sound is detected by the monitoring audio device, notifying that the emitted audible test sound is detected, and stopping emission of audible test sound from the emitting audio device if the number of notifications exceeds a threshold.

4. The method according to claim 1, wherein the plurality of audible test sounds is emitted with decreasing audio level, the method further comprising:

for each monitoring audio device, if the audible test sound is detected by the monitoring audio device, notifying that the emitted audible test sound is detected.

5. The method according to claim 4, further comprising stopping emission of audible test sound from the currently emitting audio device if no monitoring audio device is longer detecting the audible test sound.

6. The method according to claim 1, further comprising storing, in the database, information pertaining to a geographical position of the currently emitting audio device and information pertaining to a geographical position of the monitoring audio device.

7. The method according to claim 1, further comprising grouping, based on information stored in the database, the audio devices of the audio notification system into subgroups of audio devices, wherein each subgroup of audio devices comprises two or more audio devices.

8. The method according to claim 1, further comprising setting, for each of the audio devices in the system, the audio level of the audio device based on information stored in the database.

9. The method according to claim 8, further comprising:

detecting that an audio device of the system is defective; and adjusting the audio levels of the remaining audio device based on information already stored in the database.

10. The method according to claim 9, wherein the step of adjusting comprises comparing, for each of the remaining audio devices, the stored information pertaining to the audio level of the emitted audible test sound from the defective audio device for determining the audio device among the remaining audio devices having detected emitted audible test sound from the defective audio device having the lowest audio level and increasing the audio level emitted by the determined audio device such that the defective audio device is compensated for.

11. The method according to claim 9, wherein the step of adjusting comprises determining a subgroup of audio devices comprising the defective audio device and increasing the audio level emitted by the rest of the audio device in the determined subgroup of audio devices such that the defective audio device is compensated for.

12. The method according to claim 1, wherein the audio notification system is an emergency notification system.

* * * * *